US008220406B2

(12) United States Patent
Pollack

(10) Patent No.: US 8,220,406 B2
(45) Date of Patent: Jul. 17, 2012

(54) OFF-SHORE STRUCTURE, A BUOYANCY STRUCTURE, AND METHOD FOR INSTALLATION OF AN OFF-SHORE STRUCTURE

(75) Inventor: Jack Pollack, Houston, TX (US)

(73) Assignee: Single Buoy Moorings Inc., Marly (CH)

( * ) Notice: Subject to any disclaimer, the term of this patent is extended or adjusted under 35 U.S.C. 154(b) by 66 days.

(21) Appl. No.: 12/676,038

(22) PCT Filed: Sep. 2, 2008

(86) PCT No.: PCT/EP2008/061574

§ 371 (c)(1),
(2), (4) Date: Mar. 2, 2010

(87) PCT Pub. No.: WO2009/030689

PCT Pub. Date: Mar. 12, 2009

(65) Prior Publication Data

US 2010/0175606 A1 Jul. 15, 2010

(30) Foreign Application Priority Data

Sep. 3, 2007 (EP) ..... 07075754

(51) Int. Cl.
*B63B 35/44* (2006.01)

(52) U.S. Cl. ..... 114/265; 114/125; 114/333

(58) Field of Classification Search ..... 114/122, 114/125, 264, 265, 266, 267, 333
See application file for complete search history.

(56) References Cited

U.S. PATENT DOCUMENTS 2,889,795 A * 6/1959 Parks ..... 114/122
3,537,412 A * 11/1970 Henderson ..... 114/122
4,140,074 A * 2/1979 Bergman ..... 114/125
4,231,313 A * 11/1980 Heerema et al. ..... 114/265
4,366,766 A * 1/1983 Bergman ..... 114/125
5,980,159 A 11/1999 Kazim
6,213,045 B1 4/2001 Gaber
6,431,107 B1 8/2002 Byle

FOREIGN PATENT DOCUMENTS

GB 2 314 047 12/1997
WO 03/070562 8/2003

OTHER PUBLICATIONS

International Search Report dated Jan. 28, 2009, from corresponding PCT application.

* cited by examiner

*Primary Examiner* — Lars A Olson
(74) *Attorney, Agent, or Firm* — Young & Thompson

(57) ABSTRACT

A buoyant submersible structure floating above the sea floor includes a support portion to support a load, and a gas-filled tank. The tank has an opening, and a connected tube. The tube is partially filled with seawater defining a water-gas interface at a first level. In operation, the structure is fully submerged below the water surface to a first depth. The second chamber is partially filled with seawater defining a water-gas interface at a first position inside the second chamber. Then, the buoyancy structure is moved to a second, greater depth. Water enters the second chamber to raise the water-gas interface to a second, higher level and without entering the first chamber. Subsequently, the buoyancy of the structure is adjusted to tension the cable, a support structure to support a load is attached to the structure, and then the buoyancy of the structure is readjusted.

24 Claims, 6 Drawing Sheets

OFF-SHORE STRUCTURE, A BUOYANCY STRUCTURE, AND METHOD FOR INSTALLATION OF AN OFF-SHORE STRUCTURE

The invention relates to an off-shore structure comprising:
a support structure to support a load,
a buoyancy structure attached to the support structure, the buoyancy structure being adapted to be fully submerged below a water surface and to float above the sea floor.

BACKGROUNG OF THE INVENTION

U.S. Pat. No. 6,213,045 discloses a spar buoy that is connected to the seafloor by catenary mooring lines. The spar buoy comprises a buoyancy structure having buoyancy tubes that are each provided with an extension tube extending downwardly from the buoyancy tube and being open at its bottom. For stability reasons, the centre of buoyancy (CB) is above the centre of gravity (CG), so that the spar buoy has a lower truss section provided with ballast and an upper flotation section that is located in the wave active zone. As a result, the spar buoy is subject to wave induced motions in the vertical and lateral directions. When the structure moves up and down in a storm, the air will move periodically to a lower level or higher level in the extension tube, respectively.

U.S. Pat. No. 6,431,107 discloses a Tension Leg Platform (TLP). The TLP comprises a superstructure elevated above the water surface upon a cross-braced truss support structure. The truss support structure extends a distance below the water surface and engages a submerged hull structure which provides the required buoyancy. Tendons are attached between the hull structure and the seafloor. The hull structure is provided with a plurality of permanent buoyancy tanks, located above a plurality of variable ballast/oil storage tanks, as well as permanent solid ballast.

If the hull structure is to be deeply submerged, e.g. completely below the wave active zone to reduce wave induced forces acting on the hull structure, the external water pressure acting on the permanent buoyancy tanks will increase. The permanent buoyancy tanks must have sufficient structural strength to withstand the external water pressure below the wave active zone. Thus, the permanent buoyancy tanks will normally be made of steel plates which are reinforced with e.g. internal ribs and stiffeners. This results in a higher weight of the permanent buoyancy tanks. Also, steel is particularly susceptible to corrosion by sea water. The maintenance costs of steel structures are relatively high.

SUMMARY OF THE INVENTION

It is an object of the invention to provide an improved off-shore structure, in particular having a soft buoyancy tank at low costs.

This object is achieved by an off-shore structure comprising a support structure to support a load, a buoyancy structure attached to the support structure, the buoyancy structure being adapted to be fully submerged below a water surface and to float above the sea floor, the buoyancy structure comprising at least one buoyancy tank that is provided with a first chamber adapted to be filled with a gas under pressure, and a second chamber being in fluid communication with the first chamber, the second chamber being adapted to be partially filled with sea water defining a water-gas interface therein, the volume of the first chamber being substantially larger than the volume of the second chamber and the buoyancy structure being adapted to be moved from a first depth to a second depth greater than the first depth, wherein the height of the second chamber and the position of the water-gas interface inside the second chamber at the first depth are adapted such that the water-gas interface rises inside the second chamber without entering the first chamber when the buoyancy structure is moved from the first depth to the second depth.

The buoyancy structure of the off-shore structure according to the invention comprises one or more buoyancy tanks. At least some of the buoyancy tanks are pressure-balanced. The first and second chambers of the pressure-balanced buoyancy tank are filled with a gas, such as air or any other suitable gas. The volume of the first chamber is large relative to the volume of the second chamber. For example, it is one or more orders of magnitude larger, i.e. the volume ratio is 10-100 or more. It is possible that the first chamber is provided with an opening, and the second chamber is connected to said opening so as to provide the fluid communication to the first chamber. The opening between the first and second chamber provides a passage. It is possible for fluid such as gas to flow from the first chamber into the second chamber and vice versa. The second chamber also has an opening, which is in fluid communication with the sea water, i.e. sea water may enter the second chamber. Thereby, the second chamber is open to ambient pressure of sea water. After the off-shore structure has been installed, at least a portion of the second chamber is filled with water such that the water-gas interface extends within the second chamber at an initial position when the buoyancy structure is at a first depth. The gas inside the buoyancy tank and inside a portion of the second chamber is pressurized. The pressure at the water-gas interface equals the external water pressure at the same level. The gas within the first chamber is isolated from the sea water, because it is closed off by the water-gas interface in the second chamber.

When the buoyancy structure is sunk down to a greater depth, e.g. completely below the wave active zone, sea water will enter the second chamber. The water-gas interface will move upward within the second chamber to a higher position. The initial position of the water-gas interface inside the second chamber is located well below the passage between the first chamber and the second chamber such that the water-gas interface is maintained inside the second chamber. As the volume ratio of the first chamber to the second chamber is (very) large, the internal pressure inside the first chamber effectively does not change. The volume of water entering the second chamber is relatively small—compared to the volume of water that would enter the first chamber if the second chamber was omitted. The internal pressure increase in the first chamber to account for the addition of gas from the second into the first chamber is negligible. As a result, when the buoyancy tank is lowered to a greater depth, although the external water pressure increases, the differential water pressure on the first chamber reduces while the overall buoyancy of the buoyancy tank, i.e. of the first and second chambers together, is preserved to a large extent. At the same time, although the buoyancy structure is moved to a greater depth, the pressure differential between the interior and the exterior of the first chamber of the buoyancy tank remains relatively low. As a result, the buoyancy tank can be of relatively light weight while having the structural strength required to resist the external water pressure. Also, the buoyancy tank can be made of weaker non-corroding materials, such as reinforced plastic, which reduces maintenance costs.

The height of the second chamber and the initial position of the water-gas interface is such that water is prevented from entering the first chamber. For example, the height of the second chamber is equal to half of the height or the full height of the first chamber. However, the height of the second chamber may be larger or shorter, such as larger than a quarter of the height of the first chamber or any other suitable height.

It is possible that the buoyancy structure is at least 30 meters below the water surface, such as at a depth of 40, 50, 100 meters or more. Then, the buoyancy tanks are normally completely below the wave active zone. The wave active zone is the zone adjacent to the water surface in which any buoyant or floating structure is subjected to various forces resulting from the waves, the wind, or possibly other forces acting on the structure. In most circumstances the wave active zone extends not more than 30 meters below the water surface. However, under certain operational conditions the wave active zone may extend to a lesser or greater depth.

In an embodiment the support structure is mounted on the buoyancy structure. The support structure is above the buoyancy structure when the off-shore structure is in operation. It is possible that the support structure is an open structure, such as a truss structure, allowing waves and current to pass through the truss, inducing relatively small hydrodynamic forces upon it.

The first and second chambers of the buoyancy tank may have any cross-sectional shape, e.g. circular, prismatic, rectangular, etcetera. In an embodiment the first chamber of the buoyancy tank comprises a circumferential wall having a first diameter, and wherein the second chamber of the buoyancy tank comprises a tubular wall having a second diameter, and wherein the second diameter is smaller than the first diameter. Thus, the buoyancy tank is particularly suitable for withstanding internal pressures.

For example, the second chamber of the buoyancy tank comprises a tube. The diameter of the tube may be at least 0.01 meters. The second chamber of the buoyancy tank comprises may also comprise a flexible hose, if so desired provided with a weight at its lower end. This weight causes the flexible hose to hang substantially vertically downward in the water. Alternatively, the flexible hose could be replaced by a rigid tube, but a combination of a rigid tube and a flexible hose and any other suitable chamber is possible as well.

In an embodiment the first chamber of the buoyancy tank and second chamber of the buoyancy tank are releasably connected to each other. The first chamber of the buoyancy tank remains clear of water, which reduces corrosion of the first chamber. The second chamber of the buoyancy tank contains both gas and water. Due to corrosion the life cycle of the second chamber is shorter than the life cycle of the first chamber. The second chamber can be disconnected from the first chamber and replaced separately while keeping the first chamber in place.

In an embodiment the gas under pressure in the first chamber is air, and a fluid having a density between the densities of air and water, such as oil, may be placed between the water-air interface. This reduces water vapour in the first chamber and reduces corrosion in the first chamber.

In an embodiment the fluid communication between the first and second chamber of the buoyancy tank can be closed off by a valve. Advantageously, the valve is mounted at or near the opening between the first and second chamber. During installation, the valve is open to allow pressure balancing between the interior and exterior of the buoyancy tank. Once the buoyancy tank is installed at its desired depth, the valve can be closed. The buoyancy tank then constitutes a closed tank. The internal pressure of the closed tank is within the pressure range of the surrounding sea water at the installed depth.

In an embodiment the buoyancy tank is provided with a gas inlet for supplying gas into the buoyancy tank so as to push the water-gas interface in the second chamber downward. Air or any other suitable gas can be pumped through the gas inlet into the buoyancy tank to raise the internal pressure. As a result, the water-gas interface descends within the second chamber.

For example, the gas inlet is located in the lower end of the first chamber and connected to a duct and a compressor. The gas inlet may be provided with a control valve to prevent gas trapped in the buoyancy tank from escaping. Alternatively, the gas inlet could be placed near the bottom of the second chamber. If gas accidentally escapes through the gas inlet, this location would ensure that it does not empty the second chamber and thus compromise the buoyancy tank.

It is possible that the first chamber of the buoyancy tank comprises at least one relief valve for lowering gas pressure within the buoyancy tank. The relief valve can be used for trimming the buoyancy structure. For example, the relief valve is operated to lower the internal pressure in the buoyancy tank, whereby water may be allowed to enter the second chamber. This reduces the internal pressure of the buoyancy structure.

The pressure within the pressure-balanced first and second chambers is different at all locations other than at the water-gas interface. If the first or second chamber is opened at any other location, this will cause a fluid flow. For inspection of the buoyancy chamber with manned access there can be provided a man hole to the buoyancy chamber that has no differential pressure. This type of access can be provided, for example, by flooding the buoyancy chamber or by having a pressure-balanced manhole.

For example, inspection can be accomplished by flooding the first and second chambers using a valve that can provide a fluid communication with the sea water at the top of the first chamber. After flooding the manhole can be opened and a wet inspection is possible. The lost buoyancy during the inspection can be offset by adding buoyancy to other tanks.

Alternatively, inspection can be accomplished by having a downforcing access chamber, which is sufficiently large for manned access to the first chamber, extending to an elevation below the bottom of the first chamber. A by-pass tube with valve can be placed in fluid communication between the first chamber and the access chamber. When the valve in said by-pass tube is opened, gas from the first chamber flows into the access chamber and into the sea. This flow will stop when the gas pressure at the bottom of the access chamber is equal to the pressure of the sea at this level. The pressure in the access chamber now equals that of the first chamber and the manhole can be opened as the pressure across it is equalized. The first chamber can now be inspected in a dry pressurized state.

In an embodiment the off-shore structure comprises a lateral mooring system comprising a plurality of mooring lines adapted to be connected to the seafloor. The mooring lines can be attached to the support structure and/or the buoyancy structure.

It is possible that at least one tether member is provided that extends substantially vertically between the buoyancy structure and the sea floor, said tether member being tensioned by the buoyancy of the buoyancy structure. Thus, the tether member is tensioned in the substantially vertical direction. This reduces heave of the off-shore structure.

For off-shore structures that are tethered to the seabed, such as TLP and tension leg buoys, the tether member can be constructed in various ways. For example, the tether member comprises a steel tendon and/or a polyester cable. However, different types of hard tendons, soft tendons or any other suitable tether member can be used to restrain heave motions of the floating structure.

In an embodiment the buoyancy structure is mounted on a ballast structure having a truss portion and a ballast portion below the truss portion. The ballast portion ensures that the centre of gravity (CG) is located below the centre of buoyancy (CB). This is advantageous for stability of the off-shore structure.

The invention also relates to a buoyancy structure being adapted to be fully submerged below a water surface and to float above the sea floor, the buoyancy structure comprising at least one buoyancy tank that is provided with a first chamber adapted to be filled with a gas under pressure, and a second chamber being in fluid communication with the first chamber, the second chamber being adapted to be partially filled with sea water defining a water-gas interface therein, the volume of the first chamber being substantially larger than the volume of the second chamber, the buoyancy structure being adapted to be moved from a first depth to a second depth greater than the first depth, and wherein the height of the second chamber and the position of the water-gas interface inside the second chamber at the first depth are adapted such that the water-gas interface rises inside the second chamber without entering the first chamber when the buoyancy structure is moved from the first depth to the second depth.

For example, the second chamber extends substantially vertically downward over a distance that is equal to or larger than half of or the full height dimension of the first chamber. When the first chamber is lowered to a greater depth over such a distance, the water-gas interface will remain within the second chamber. As a result, the buoyancy of the buoyancy structure is substantially preserved. Also, the first chamber remains clear of water.

The invention further relates to the use of a buoyancy structure as described above for reducing buoyancy loss when said structure is moved from a first depth to a second depth greater than the first depth.

The invention furthermore relates to a method for installing an off-shore structure, comprising:

- providing a buoyancy structure comprising at least one buoyancy tank that is provided with a first chamber filled with a gas under pressure, and a second chamber being in fluid communication with the first chamber, the volume of the first chamber being substantially larger than the volume of the second chamber,
- submerging the buoyancy structure of the substructure fully below the water surface so as to be floating above the sea floor at a first depth, wherein the second chamber is partially filled with sea water defining a water-gas interface below the opening at a first position inside the second chamber,
- moving the buoyancy structure to a second depth that is greater than the first depth, e.g. by ballasting, wherein water is allowed to enter the second chamber so as to raise the water-gas interface to a second position inside the second chamber higher than the first position and without entering the first chamber.

For example, the first chamber is provided with an opening, and the second chamber is connected to said opening so as to provide the fluid communication to the first chamber. The second position or level of the water-gas interface is located below the opening between the first and second chamber of the buoyancy tank. The displacement to the greater depth and the height of the second chamber are designed such that the water rising inside the second chamber does not reach the opening between the first and second chamber. The gas inside the buoyancy tank remains inside it when the buoyancy structure is moved from the first depth to the second greater depth. Because the volume of the second chamber is small relative to the volume of the first chamber, the internal pressure within the first chamber remains substantially the same. As a result, the buoyancy of the first chamber is substantially preserved. Also, the first chamber remains dry, which reduces corrosion.

It is possible that the buoyancy structure comprises a gas inlet provided with a control valve, wherein gas is supplied through the gas inlet for moving the water-gas interface to a third position inside the second chamber lower than the second level. Subsequently, the buoyancy structure may be moved to a third depth that is greater than the second depth, wherein water is allowed to enter the second chamber so as to raise the water-gas interface from the third position to a fourth position inside the second chamber higher than the third position and below the opening. The buoyancy structure can be moved down in steps that are not greater than the length of the second chamber. When the water-gas interface reaches the opening to the first chamber, a gas is pumped into the first chamber to push the water level down to the bottom of the second chamber. Now the buoyancy structure can be moved down again by the length of the second chamber. This could be repeated as many times as desired.

The fluid communication between the first and second chamber of the buoyancy tank may be closed by a valve after tensioning the tether member. In this case, at the end of the installation of the off-shore structure, the buoyancy tank is closed off by the valve. Then, it constitutes a closed buoyancy tank at a high pressure. The construction of the closed buoyancy tank can be relatively simple and light.

BRIEF DESCRIPTION OF THE DRAWINGS

The invention will now be explained in more detail with reference to the accompanying drawing.

DETAILED DESCRIPTION OF THE PREFERRED EMBODIMENTS

Figure 1:
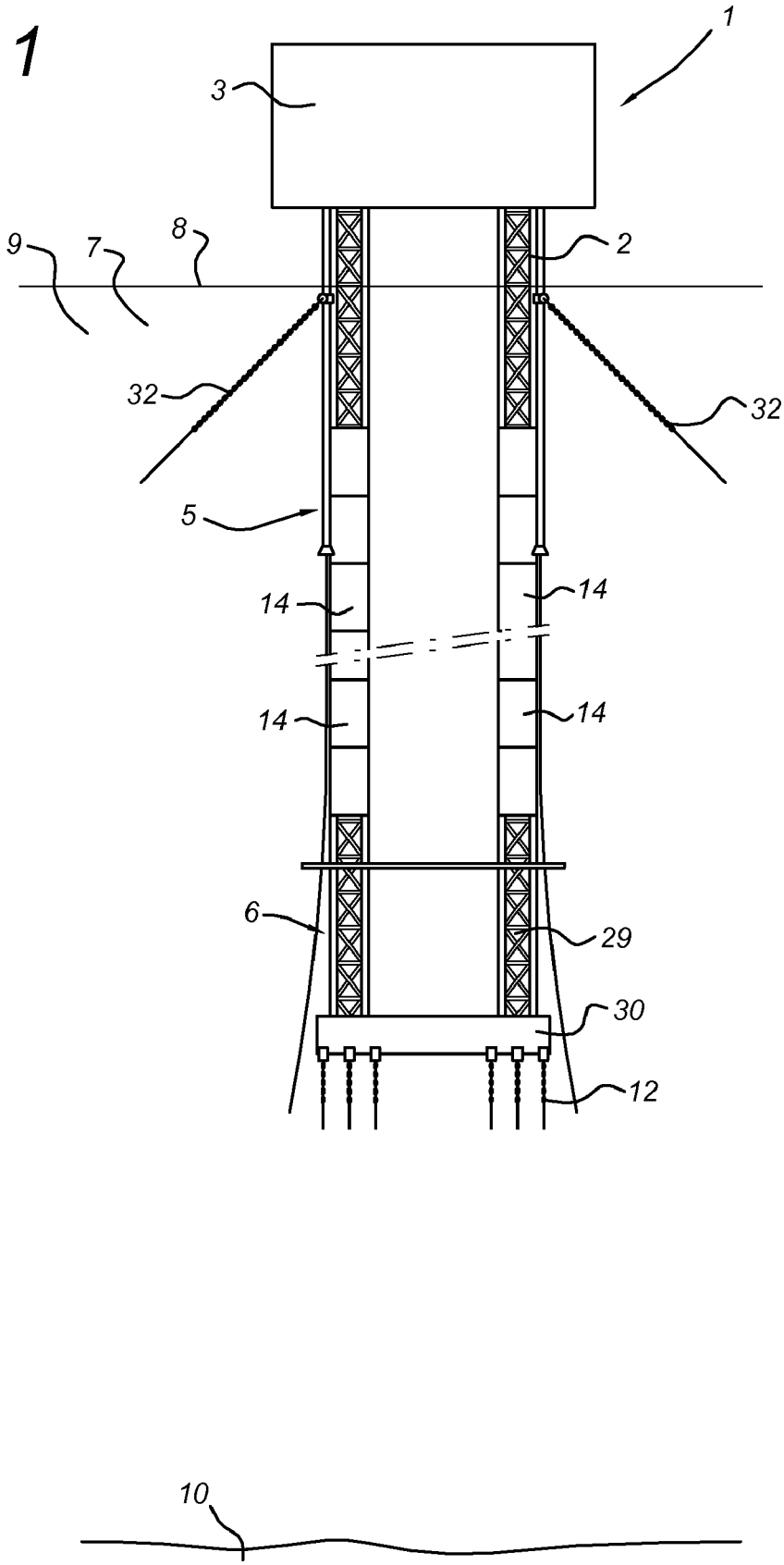
FIG. 1 shows a first embodiment of an off-shore structure according to the invention.

The off-shore structure shown in FIG. 1 is indicated in its entirety by reference numeral 1. The offshore structure 1 forms a hydrocarbon production system which is in particular suitable for water depths greater than 1000 meters. The off-shore structure 1 comprises a truss support structure 2 which supports a superstructure 3 above the water surface 8 of a body of water 7, such as a sea. The body of water 7 has an area near the water surface 8 wherein the majority of the wave induced hydrodynamic forces occur, which shall be referred to as the wave active zone 9. The superstructure 3 may comprise a deck structure, equipment for drilling and producing hydrocarbons and other structures (not shown).

The truss support structure 2 is partially submerged into the water 7. Below the water surface 8 the truss support structure 2 is attached to a buoyancy structure 5. The buoyancy structure 5 is under the truss support structure 2. The truss support structure 2 extends to a depth under the water surface 8 such that the buoyancy structure 5 is completely below the normal wave active zone 9. In this exemplary embodiment the upper end of the buoyancy structure 5 is at a depth of 30 m.

The buoyancy structure 5 comprises a plurality of buoyancy tanks 14 and a truss ballast structure 6 mounted under the buoyancy tanks 14. The truss ballast structure has a truss portion 29 and a ballast portion 30. Due to the truss ballast structure 6 the centre of gravity (CG) lies under the centre of buoyancy (CB).

The offshore structure 1 comprises a plurality of tether members 12 which are each connected between the ballast portion 30 of the buoyancy structure 5 and the seafloor 10. In this exemplary embodiment the tether members 12 are formed by polyester tethers, but the tether members 12 can also be hard tendons or soft tendons. The tether members 12 are tensioned by the buoyancy provided by the buoyancy structure 5. The tether members 12 limit upward vertical displacement of the offshore structure 1. A system of catenary mooring lines 32 controls the pitch and surge excursions of the offshore structure 1.

Figure 2A:
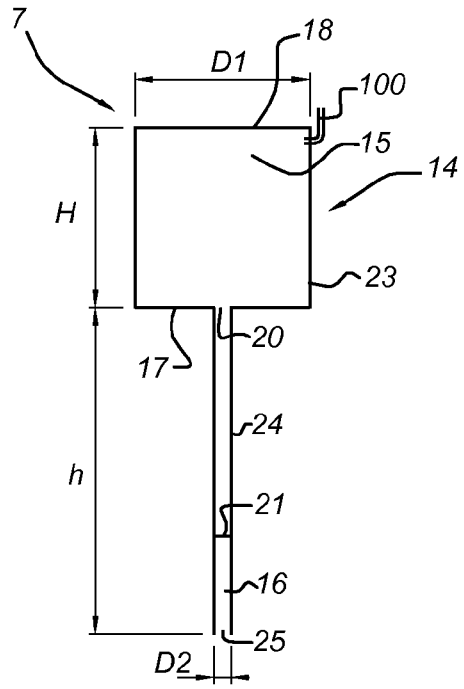
FIG. 2*a* shows a buoyancy tank of the off-shore structure shown in FIG. 1 at a first depth.
Figure 2B:
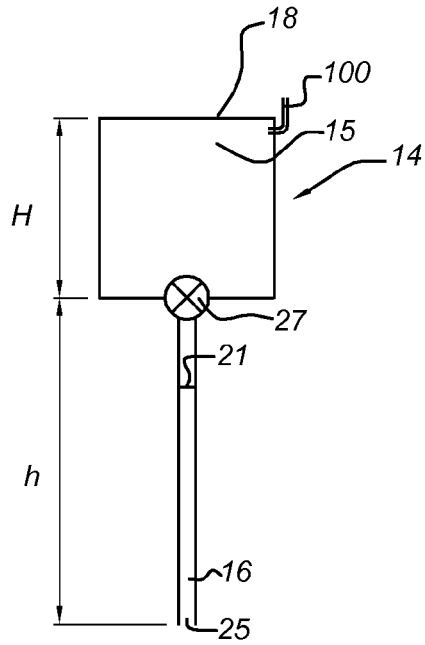
FIG. 2*b* shows the buoyancy tank shown in FIG. 2*a* at a second depth greater than the first depth.

FIGS. 2*a* and 2*b* schematically show one buoyancy tank 14 of the buoyancy structure 5. The buoyancy tank 14 comprises a first chamber 15 and a second chamber 16. The height h of the second chamber 16 is such that water is prevented from entering the first chamber 15. For example, the height h of the second chamber 16 is equal to or larger than the height H of the first chamber 15. However, the height h of the second chamber 16 may be shorter, such as equal to half of the height H of the first chamber 15 or any other suitable height (not shown). In this exemplary embodiment, the first chamber 15 has a circumferential wall 23 which is closed at its upper end by an upper end wall 18. The first chamber 15 has a bottom wall 17 that is provided with an opening 20. The opening 20 can be closed off by a valve 27 (depicted in FIG. 2*b* only). The circumferential wall 23 has a first diameter $D_1$.

The second chamber 16 comprises a tubular wall 24 which has a bottom opening 25 at its lower end. The upper end of tubular wall 24 is fitted to the opening 20. The tubular wall 24 has a second diameter $D_2$ which is smaller than the first diameter $D_1$ of the first chamber 15. In this exemplary embodiment, the tubular wall 24 is formed by a rigid steel tube. The diameter $D_2$ can be as small as 0.01 m. When the valve 27 is open, the opening 20 provides fluid communication between the first chamber 15 and the second chamber 16.

The interior of the buoyancy tank 14 is filled through an inlet 100 with a gas under pressure, such as pressurized air. As the buoyancy tank 14 is submerged under water, the external water pressure of the body of water 7 causes water to enter through the bottom opening 25 of the second chamber 16. A water-gas interface 21 is formed within the second chamber 16. The gas inside the buoyancy tank 14 is at an internal gas pressure. The internal gas pressure inside the second chamber 16 is controlled such that the water-gas interface 21 is at a position or level near the lower end of the second chamber 16 (see FIG. 2*a*).

FIG. 2*b* shows that the water-gas interface 21 rises within the second chamber 16 when the buoyancy tank descends to a greater depth. A volume of water enters the second chamber 16 through its bottom opening 25. Thus, the open buoyancy tank 14 is pressure-balanced, which reduces its weight because otherwise a closed buoyancy tank would have to be reinforced heavily to withstand the water pressure at greater depths.

The water-gas interface 21 remains below the opening 20—the first chamber 15 is kept clear of water. This reduces corrosion of the first chamber 15. Furthermore, as the diameter $D_2$ of the second chamber 16 is smaller than the diameter $D_1$ of the first chamber 15, the volume of water that has entered the second chamber 16 is relatively small. Consequently, when the open buoyancy tank 14 is sunk down, its buoyancy loss is relatively low.

Figure 2C:
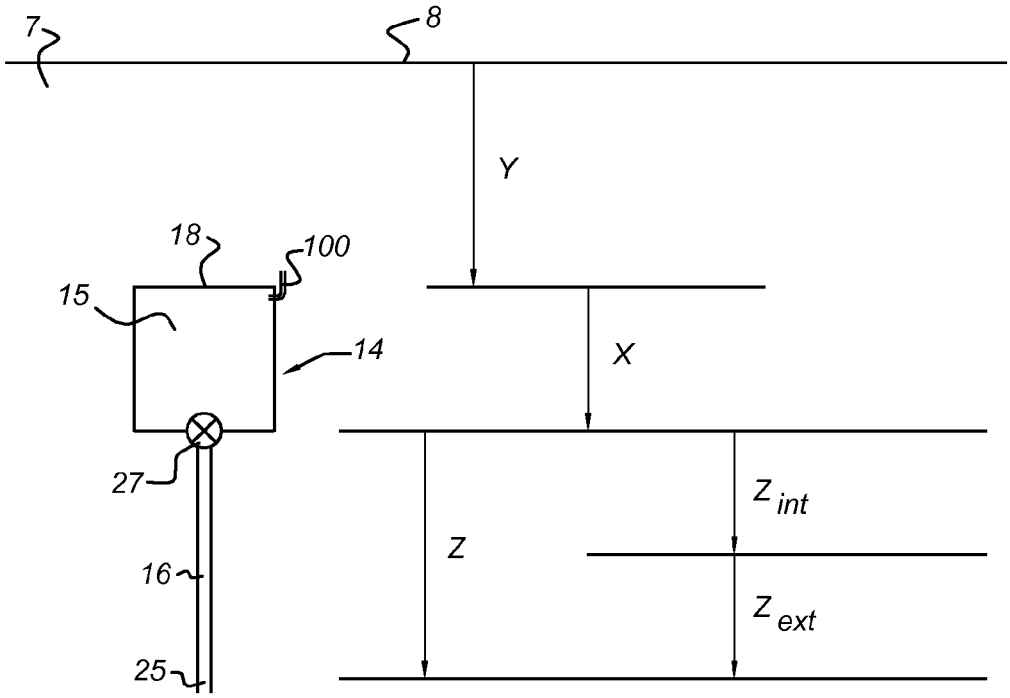
FIG. 2*c* shows the buoyancy tank shown in FIG. 2*a* being subjected to differential pressures.
Figure 2D:
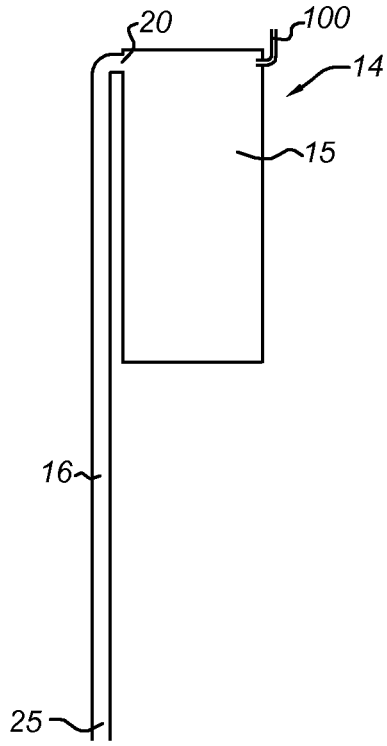
FIGS. 2*d*-2*g* show a plurality of configurations for buoyancy tanks according to the invention, respectively.
Figure 2E:
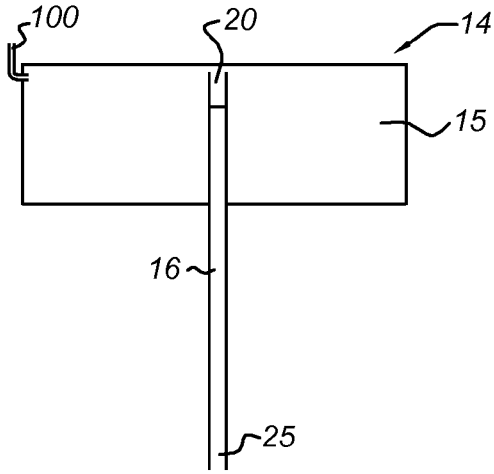
Figure 2F:
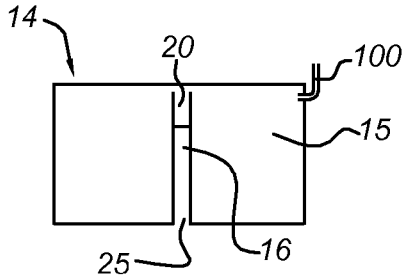
Figure 2G:
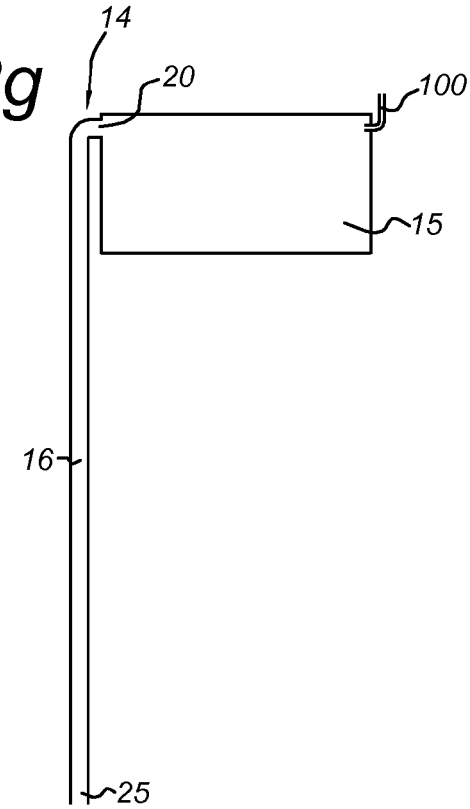

The buoyancy tank shown in FIG. 2*c* is substantially the same as the buoyancy tank shown in FIGS. 2*a* and 2*b*. The same and similar parts are designated by the same reference numerals. FIG. 2*c* illustrates different pressures acting on the first and second chambers 15, 16 of the buoyancy tank 14 at different depths. The weight of the buoyancy tank 14 increases when it has to withstand greater differential pressure. In FIG. 2*c* the first chamber 15 of the buoyancy tank 14 has a height X and is operated at a depth Y below the water surface 8. At this depth Y it is subjected to additional differential pressures corresponding to a depth variation Z. The depth variation Z is, for example, a combination of structure set down resulting from vertical mooring forces, damage conditions, and tide and wave action when present at the operating depth. When the buoyancy tank 14 is installed and operational, the lower end of the first chamber 15 is at a depth Y+X and, in this exemplary embodiment, the lower end of the second chamber 15 is at a depth greater than X+Y+Z.

If the first chamber 15 were made up of primarily flat surfaces it would be able to take roughly the same internal as external pressure. This would result in an efficient buoyancy design whenever the operational depth Y to the upper end wall 18 of the first chamber 15 is greater than the total height of the buoyancy chamber 14 X+Z. If the design of the first chamber 15 is such that its capabilities to withstand internal and external pressure are different, the internal pressure strength will govern the design. This design would therefore focus on having equal or greater internal than external pressure capabilities.

It is also possible that the soft volume is used only to install the structure. The structure with the first chamber provided with soft buoyancy can be closed by a valve 27, resulting in a hard pressurized tank. The structural efficiency and/or weight of the buoyancy tank, in particular the first chamber, can be improved as the additional pressures corresponding to the depth variation Z can be shared by internal and external pressures. When this method is used the sum of the internal and external pressure capabilities of the first chamber can be used to equal the additional pressures corresponding to the depth variation Z. In this case, assuming, for example, the internal and external pressure capabilities were equal for the first chamber, the first chamber would be brought to the depth equal to the sum of $Y+X+Z_{int}$, and then the valve 27 would be closed. Once the first chamber is at such pressure, it can operate over the depth variation Z at both internal and external pressure.

FIGS. 2*d*-2*g* show a plurality of exemplary embodiments of buoyancy tanks according to the invention. The same and similar parts are designated by the same reference numerals. Of course, many other configurations are possible according to the invention.

It is possible for the buoyancy tanks, e.g. the buoyancy tanks shown in FIGS. 2*a*-2*g*, to be firstly pressurized actively. Then, the open buoyancy tank allows a variation in depth without pressurizing actively—no pressure is added actively. The variation in depth is controlled by the second chamber.

The height of the second chamber is sufficiently great to avoid water from entering into the first chamber.

Figure 3:
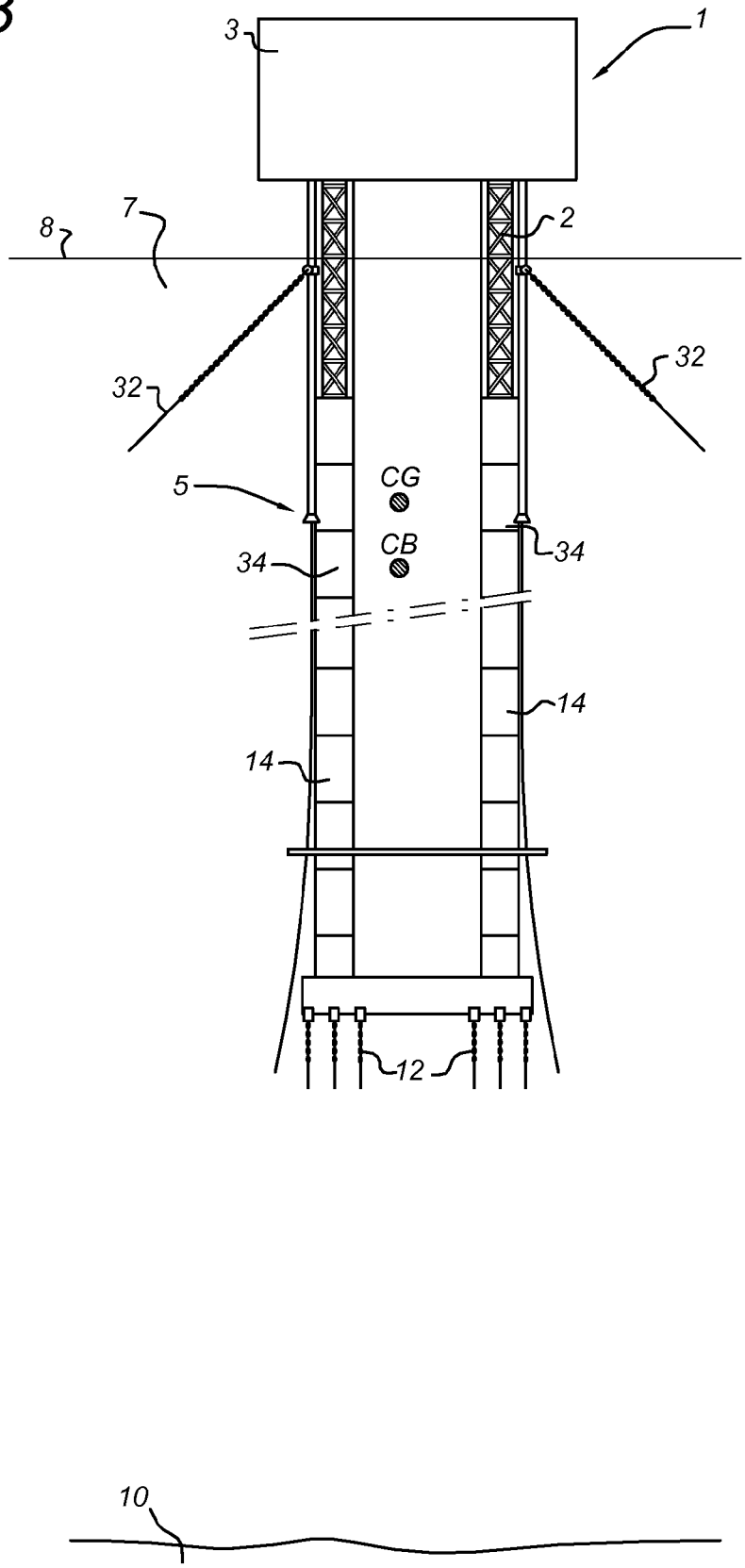
FIG. 3 shows a second embodiment of an off-shore structure according to the invention.

FIG. 3 shows a second embodiment of an offshore structure according to the invention. The same and similar parts are designated by the same reference numerals. The offshore structure 1 shown in FIG. 3 has a combination of closed buoyancy tanks 34 and pressure-balanced buoyancy tanks 14. The closed buoyancy tanks 34 are placed above the pressure-balanced buoyancy tanks 14. The water pressure at the depth of the closed buoyancy tanks 34 may not yet require heavy reinforcements.

Figure 4:
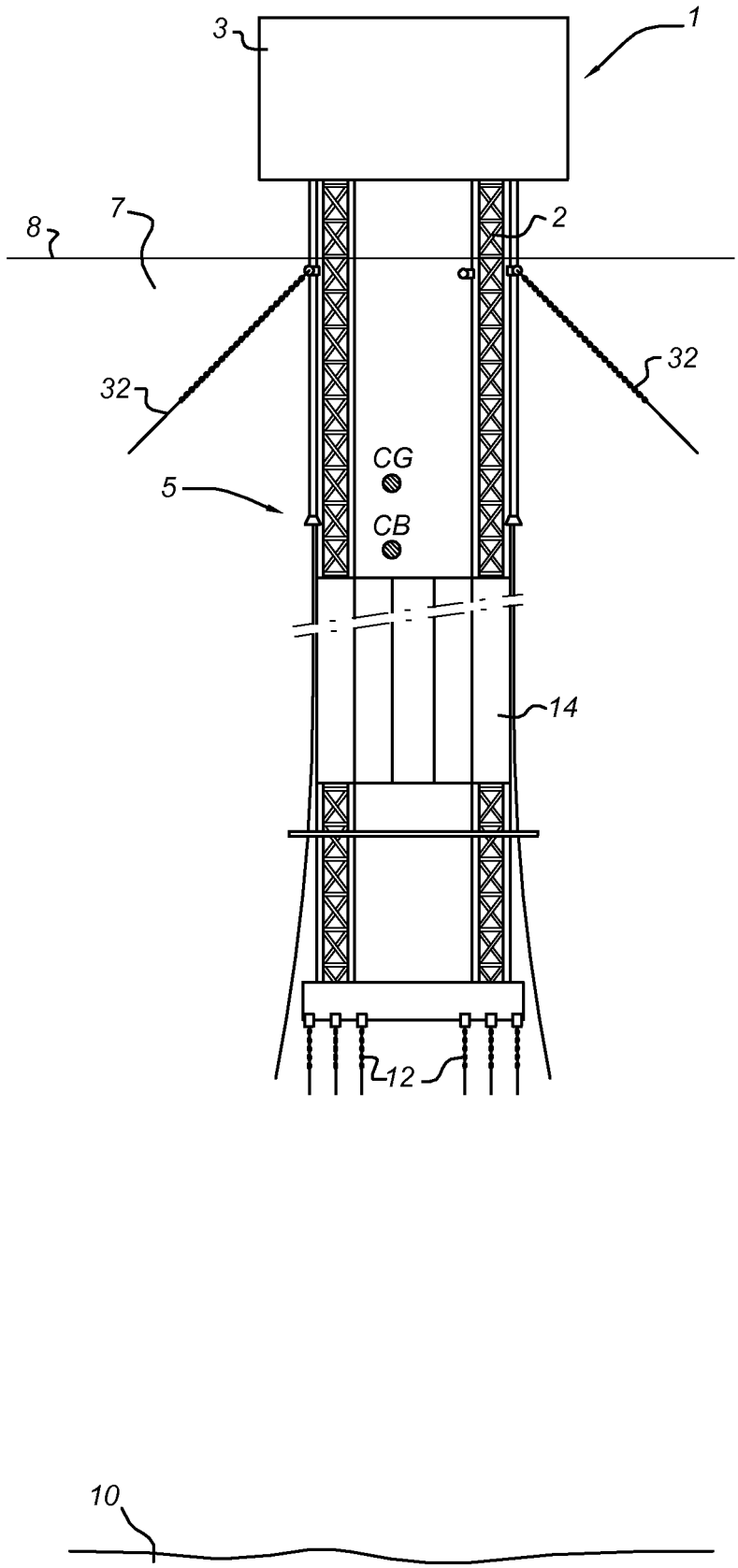
FIG. 4 shows a third embodiment of an off-shore structure according to the invention.

FIG. 4 shows a third embodiment of an offshore structure according to the invention. The same and similar parts are designated by the same reference numerals. The offshore structure 1 shown in FIG. 4 also comprises a combination of closed buoyancy tanks 34 and open buoyancy tanks 14. However, in this exemplary embodiment the buoyancy tanks 34, 14 are mounted in the centre of the offshore structure 1 as well.

Figure 5:
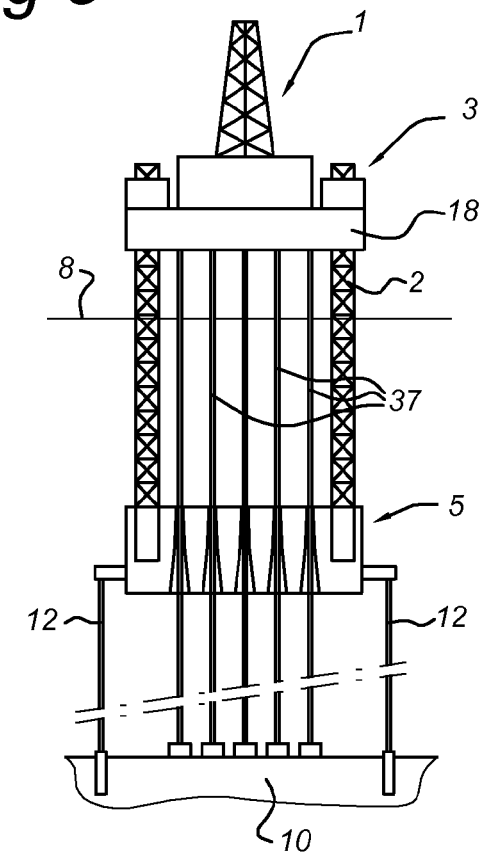
FIG. 5 shows a fourth embodiment of an off-shore structure according to the invention.

FIG. 5 shows a fourth embodiment of an offshore structure according to the invention. The same and similar parts are designated by the same reference numerals. The offshore structure 1 shown in FIG. 5 comprises a support structure 2 that is provided with truss legs that are stabbed into the buoyancy structure 5. The support structure 2 supports a superstructure 3 having a deck 18. The buoyancy structure 5 comprises a combination of closed buoyancy tanks and pressure-balanced buoyancy tanks as depicted in FIGS. 2*a*, 2*b* and 3 (not shown). The buoyancy structure 5 is connected to the sea floor 10 by tethers 12. Steel vertical risers 37 extend between the sea floor 10 and the deck 18.

Figure 6:
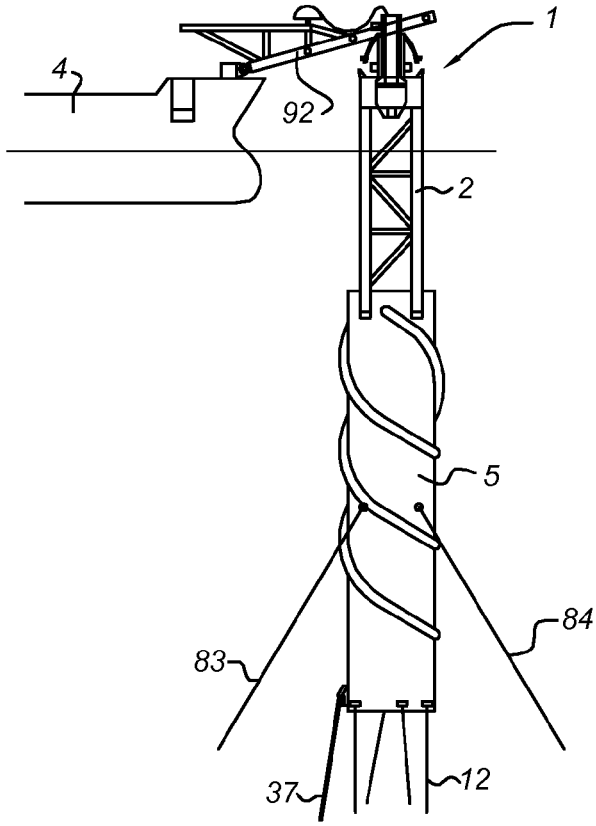
FIG. 6 shows a fifth embodiment of an off-shore structure according to the invention.

FIG. 6 shows a fifth embodiment of an offshore structure according to the invention. The same and similar parts are designated by the same reference numerals. The offshore structure 1 shown in FIG. 6 extends adjacent to the bow of a vessel 4. The offshore structure 1 comprises an upper truss support structure 2 and a lower buoyancy structure 5. Lateral mooring lines 83, 84 connect the buoyancy structure 5 to the sea floor. The buoyancy structure 5 includes buoyancy tanks as depicted in FIGS. 2*a*, 2*b* (not shown).

It is noted that the invention is not limited to the exemplary embodiments shown in the figures. The skilled person can modify the offshore structures in various ways without departing the scope of the invention.

The invention claimed is:

1. An off-shore structure (1) comprising:

a support structure (2) to support a load; and a buoyancy structure (5) attached to the support structure (2), the buoyancy structure (5) being adapted to be fully submerged below a water surface (8) and to float above the sea floor (10), the buoyancy structure (5) comprising at least one buoyancy tank (14) with a first chamber (15) adapted to be filled with a gas under pressure, and a second chamber (16) being in fluid communication with the first chamber (15), the first chamber during use being positioned above the second chamber, the second chamber (20) being adapted to be partially filled with sea water defining a water-gas interface (21) therein, the volume of the first chamber (15) being substantially larger than the volume of the second chamber (16), the horizontal cross-section of the first chamber being larger than the horizontal cross-section of the second chamber, wherein the buoyancy structure (5) is adapted to be moved from a first depth to a second depth greater than the first depth, and wherein the height of the second chamber (16) and the position of the water-gas interface (21) inside the second chamber (16) at the first depth are adapted such that the water-gas interface (21) rises inside the second chamber (16) without entering the first chamber (15) when the buoyancy structure (5) is moved from the first depth to the second depth, wherein the support structure (2) is a truss support structure mounted on top of the buoyancy structure (5), the truss support structure being adapted to be partially submerged into the water, the truss support structure (2) being attached to the buoyancy structure (5) below the water surface (8).

2. The off-shore structure according to claim 1, wherein the height of the second chamber (16) is at least equal to half of the height of the first chamber (15) or at least equal to the height of the first chamber (15).

3. The off-shore structure according to claim 1, wherein the buoyancy structure (5) is at least 30 meters below the water surface (8).

4. The off-shore structure according to claim 1, wherein the first chamber (15) of the buoyancy tank (14) comprises a circumferential wall (23) having a first diameter ($D_1$), and wherein the second chamber (16) of the buoyancy tank (14) comprises a tubular wall (24) having a second diameter ($D_2$), and wherein the second diameter ($D_2$) is smaller than the first diameter ($D_1$).

5. The off-shore structure according to claim 1, wherein the second chamber (16) of the buoyancy tank (14) comprises a tube.

6. The off-shore structure according to claim 1, wherein the second chamber (16) of the buoyancy tank (14) comprises a flexible hose (16).

7. The off-shore structure according to claim 1, wherein the first chamber (15) of the buoyancy tank (14) and second chamber (16) of the buoyancy tank (14) are releasably connected to each other.

8. The off-shore structure according to claim 1, wherein the fluid communication between the first and second chamber (15, 16) of the buoyancy tank (14) can be closed off by a valve (27).

9. The off-shore structure according to claim 1, wherein the buoyancy tank (14) has a gas inlet (100) for supplying gas into the buoyancy tank (14) so as to push the water-gas interface (21) in the second chamber (16) downward.

10. The off-shore structure according to claim 1, wherein the first chamber (15) of the buoyancy tank (14) comprises at least one relief valve for lowering gas pressure within the buoyancy tank (14).

11. The off-shore structure according to claim 1, wherein the off-shore structure comprises a lateral mooring system comprising a plurality of mooring lines (32) adapted to be connected to the seafloor (10).

12. The off-shore structure according to claim 1, wherein at least one said tether member (12) extends substantially vertically between the buoyancy structure (5) and the sea floor (10), said tether member (12) being tensioned by the buoyancy of the buoyancy structure (5).

13. The off-shore structure according to claim 12, wherein the tether member (12) comprises a steel tendon and/or a steel or synthetic cable.

14. A buoyancy structure (5) being adapted to be fully submerged below a water surface (8) and to float above the sea floor (10), the buoyancy structure (5) comprising:

at least one buoyancy tank (14) with a first chamber (15) adapted to be filled with a gas under pressure, and a second chamber (16) being in fluid communication with the first chamber (15), the first chamber during use being positioned above the second chamber, the second chamber (16) being adapted to be partially filled with sea water defining a water-gas interface (21) therein, the volume of the first chamber (15) being substantially larger than the volume of the second chamber (16), the horizontal cross-section of the first chamber being larger than the horizontal cross-section of the second chamber, wherein the buoyancy structure (5) is adapted to be moved from a first depth to a second depth greater than the first depth, and wherein the height of the second chamber (16) and the position of the water-gas interface (21) inside the second chamber (16) at the first depth are adapted such that the water-gas interface (21) rises inside the second chamber (16) without entering the first chamber (15) when the buoyancy structure (5) is moved from the first depth to the second depth, wherein the buoyancy structure (5) is arranged to support a truss support structure being mounted on top of the buoyancy structure (5), the truss support structure being adapted to be partially submerged into the water, the truss support structure (2) being attached to the buoyancy structure (5) below the water surface (8).

15. The buoyancy structure (5) according to claim 14, wherein the height of the second chamber (16) is at least equal to half of the height of the first chamber (15) or at least equal to the height of the first chamber (15).

16. A use of a buoyancy structure according to claim 14 for reducing buoyancy loss when said buoyancy structure (5) is moved from a first depth to a second depth greater than the first depth.

17. A buoyancy structure (5) comprising:

at least one buoyancy tank (14) with a first chamber (15) adapted to be filled with a gas under pressure, and a second chamber (16) being in fluid communication with the first chamber (15), the first chamber during use being positioned above the second chamber, the second chamber (16) being adapted to be partially filled with sea water defining a water-gas interface (21) therein, the volume of the first chamber (15) being substantially larger than the volume of the second chamber (16), the horizontal cross-section of the first chamber being larger than the horizontal cross-section of the second chamber, wherein the second chamber (16) is configured for controlling variation in depth under water, the internal pressure of the first chamber (15) remaining unchanged.

18. A method for installing an off-shore structure (1), comprising:

providing a buoyancy structure (5) comprising at least one buoyancy tank (14) with a first chamber (15) filled with a gas under pressure, and a second chamber (16) being in fluid communication with the first chamber (15), the first chamber during use being positioned above the second chamber, the volume of the first chamber (15) being substantially larger than the volume of the second chamber (16), the horizontal cross-section of the first chamber being larger than the horizontal cross-section of the second chamber;

submerging the buoyancy structure (5) fully below the water surface (8) so as to be floating above the sea floor (10) at a first depth, wherein the second chamber (16) is partially filled with sea water defining a water-gas interface (21) at a first position inside the second chamber (16);

moving the buoyancy structure (5) to a second depth that is greater than the first depth, wherein water is allowed to enter the second chamber (16) so as to raise the water-gas interface (21) to a second position inside the second chamber (16) higher than the first position and without entering the first chamber (15); and arranging the buoyancy structure (5) for supporting a truss support structure being mounted on top of the buoyancy structure (5), the truss support structure being adapted to be partially submerged into the water, the truss support structure (2) being attached to the buoyancy structure (5) below the water surface (8).

19. The method according to claim 18, wherein the buoyancy structure (5) is connected to the sea floor (10) using at least one tether member (12), comprising a tendon and/or a cable, after which the buoyancy of the buoyancy structure (5) is adjusted to tension said tether member (12), and wherein a support structure (2) to support a load is subsequently attached to the buoyancy structure (5), after which the buoyancy of the buoyancy structure (5) is re-adjusted.

20. The method according to claim 18, wherein the height of the second chamber (16) is at least equal to half of the height of the first chamber (15).

21. The method according to claim 18, wherein the height of the second chamber (16) is at least equal to the height of the first chamber (15).

22. The method according to claim 18, wherein the buoyancy structure (5) comprises a gas inlet (100) with a control valve, and wherein gas is supplied through the gas inlet (100) for moving the water-gas interface (21) to a third level relative to the lower end of the second chamber (16) lower than the second level.

23. The method according to claim 22, wherein the buoyancy structure (5) is moved to a third depth that is greater than the second depth, wherein water is allowed to enter the second chamber (16) so as to raise the water-gas interface (21) from the third level to a fourth level relative to the lower end of the second chamber (16) higher than the third level and without entering the first chamber (15).

24. The method according to claim 18, wherein the fluid communication between the first and second chamber (15, 16) of the buoyancy tank (14) can be closed by a valve (27).

* * * * *